US008449696B2

(12) United States Patent
Yoshida et al.

(10) Patent No.: US 8,449,696 B2
(45) Date of Patent: May 28, 2013

(54) RARE-EARTH SINTERED MAGNET CONTAINING A NITRIDE, ROTATOR CONTAINING RARE-EARTH SINTERED MAGNET, AND RECIPROCATING MOTOR CONTAINING RARE-EARTH SINTERED MAGNET

(75) Inventors: Kenichi Yoshida, Tokyo (JP); Hisayuki Abe, Tokyo (JP); Hiroshi Yamamoto, Tokyo (JP)

(73) Assignee: TDK Corporation, Tokyo (JP)

( * ) Notice: Subject to any disclaimer, the term of this patent is extended or adjusted under 35 U.S.C. 154(b) by 183 days.

(21) Appl. No.: 13/047,108

(22) Filed: Mar. 14, 2011

(65) Prior Publication Data

US 2011/0227424 A1 Sep. 22, 2011

(30) Foreign Application Priority Data

Mar. 16, 2010 (JP) ..... P2010-059463

(51) Int. Cl.
*H01F 1/08* (2006.01)
*H01F 1/053* (2006.01)

(52) U.S. Cl.
USPC ..... 148/302; 310/15

(58) Field of Classification Search
USPC ..... 148/302; 310/15
IPC ..... H01F 1/02,1/08, 1/053
See application file for complete search history.

(56) References Cited

U.S. PATENT DOCUMENTS

| | | | | |
|---|---|---|---|---|
| 4,965,864 | A * | 10/1990 | Roth et al. | 310/16 |
| 5,162,064 | A | 11/1992 | Kim et al. | |
| 5,282,904 | A | 2/1994 | Kim et al. | |
| 5,316,595 | A * | 5/1994 | Hamada et al. | 148/302 |
| 5,728,232 | A * | 3/1998 | Takahashi | 148/105 |
| 6,696,097 | B2 * | 2/2004 | Aizawa et al. | 427/123 |
| 7,364,628 | B2 * | 4/2008 | Kakimoto et al. | 148/101 |
| 7,488,395 | B2 * | 2/2009 | Nakamura et al. | 148/302 |
| 2006/0191601 | A1 * | 8/2006 | Komuro et al. | 148/302 |

FOREIGN PATENT DOCUMENTS

JP A-04-242902 8/1992

* cited by examiner

*Primary Examiner* — Tran Nguyen
*Assistant Examiner* — Michael Andrews
(74) *Attorney, Agent, or Firm* — Oliff & Berridge, PLC

(57) ABSTRACT

The present invention relates to a rare-earth sintered magnet 100 containing an R-T-B-based alloy and a nitride of a transition element, while the nitride is distributed preferentially to a surface part. (R, T, and B indicate a rare-earth element, at least one of iron and cobalt, and boron, respectively.)

8 Claims, 5 Drawing Sheets

(a)

(b)

RARE-EARTH SINTERED MAGNET CONTAINING A NITRIDE, ROTATOR CONTAINING RARE-EARTH SINTERED MAGNET, AND RECIPROCATING MOTOR CONTAINING RARE-EARTH SINTERED MAGNET

BACKGROUND OF THE INVENTION

1. Field of the Invention

The present invention relates to a rare-earth sintered magnet and a rotator and a reciprocating motor which are equipped therewith.

2. Related Background Art

Rare-earth sintered magnets mainly composed of R—Fe—B-based alloys having rare-earth elements as their constituent elements have been utilized as permanent magnets in various fields because of their favorable magnetic characteristics. Such rare-earth sintered magnets tend to corrode easily because of the rare-earth elements contained therein.

Therefore, in order to inhibit magnetic characteristics from being lowered by corrosion, it has been tried to produce rare-earth sintered magnets by using rare-earth alloy powders whose surfaces are provided with diffusion layers made of nitrogen or carbon or form protective films such as plating layers on surfaces of rare-earth sintered magnets, for example, so as to improve their resistance to corrosion. For example, the following Patent Literature 1 proposes to let a rare-earth sintered magnet contain nitrogen and carbon, thereby improving the corrosion resistance.

Patent Literature 1: Japanese Patent Application Laid-Open No. 4-242902

SUMMARY OF THE INVENTION

Technical Problem

However, when nitrogen and carbon atoms are contained in a rare-earth sintered magnet as in the above-mentioned Patent Literature 1, nitrogen and carbon may react with ingredients of the rare-earth sintered magnet, thereby making it easier to form nonmagnetic phases having a high content of rare-earth elements and impurities. Foreign phases such as nonmagnetic phases and impurities, formed as such, may produce nuclei for magnetization reversals, thereby lowering magnetic characteristics.

Even when rare-earth powders having nitrogen and carbon are sintered as materials, so as to form a rare-earth sintered magnet, nitrogen and carbon are likely to scatter away at the time of sintering, whereby nitrogen and carbon components hardly remain in the rare-earth sintered magnet, thus failing to attain effects of improving the corrosion resistance substantially. In the technique of forming a plating film on the surface of a rare-earth sintered magnet, on the other hand, there is a fear that a plating solution may produce unstable compounds within the rare-earth sintered magnet. Hence, there has been a demand for a technique which enables the rare-earth sintered magnet to fully exhibit its inherent excellent magnetic characteristics even under corrosive environments.

In view of the foregoing circumstances, it is an object of the present invention to provide a rare-earth sintered magnet having an excellent magnetic characteristic while being highly resistant to corrosion. It is another object of the present invention to provide a rotator and a reciprocating motor which can keep excellent performances over a long period.

Solution to Problem

The inventors conducted various studies concerning rare-earth sintered magnet compositions and structures and, as a result, have found it effective to distribute a specific nitride preferentially to a surface part of the rare-earth sintered magnet, thereby completing the present invention. That is, the present invention provides a rare-earth sintered magnet containing an R-T-B-based alloy and a nitride of a transition element, while the nitride is distributed preferentially to a surface part thereof. In such a rare-earth sintered magnet, the nitride of the transition element is distributed preferentially to the surface part. This nitride is excellent in corrosion resistance and thus can fully inhibit the rare-earth sintered magnet from corroding even when used under corrosive environments. Since the nitride content is lower in an inner part than in the surface part, the amount of impurities which may become nuclei for magnetization reversals can fully be reduced, whereby an excellent magnetic characteristic can be obtained. Because of these factors, a rare-earth sintered magnet having an excellent magnetic characteristic while being highly resistance to corrosion can be provided. However, the reason why the effects of the present invention are obtained is not restricted to the above-mentioned factors. In the specification, R, T, and B indicate a rare-earth element, at least one of iron (Fe) and cobalt (Co), and boron, respectively.

Preferably, the nitride in the rare-earth sintered magnet of the present invention contains TxNy. This can yield a rare-earth sintered magnet having a higher resistance to corrosion. Here, x and y are values each exceeding 0, while x/y=2 to 4.

Preferably, the rare-earth sintered magnet of the present invention has a first region substantially free of the nitride and a second region containing the nitride and covering the first region. Such a rare-earth sintered magnet can further inhibit corrosion from advancing and thus can make the magnetic characteristic higher.

Preferably, letting the surface part be a part extending by a depth of 2 μm from a surface, the surface part has a nitride content of 1 to 11 mass % in terms of nitrogen in the rare-earth sintered magnet of the present invention. This can yield a rare-earth sintered magnet having a higher resistance to corrosion.

The present invention also provides a rotator and a reciprocating motor which are equipped with the above-mentioned rare-earth sintered magnet. The rotator and reciprocating motor are equipped with the rare-earth sintered magnet having the characteristic features mentioned above and thus can keep excellent performances over a long period even when used under severe environments.

Advantageous Effects of the Invention

The present invention can provide a rare-earth sintered magnet having an excellent magnetic characteristic while being highly resistant to corrosion. It can also provide a rotator and a reciprocating motor which can keep excellent performances over a long period.

REFERENCE SIGNS LIST

Figure 1:
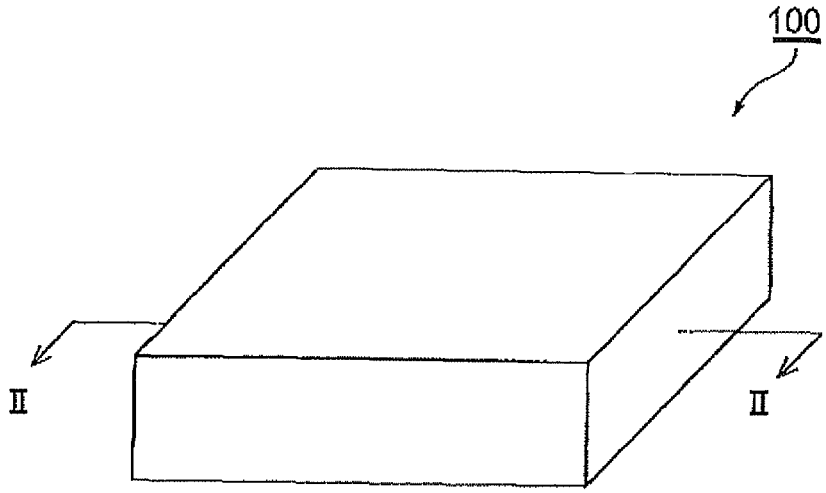
FIG. 1 is a perspective view schematically illustrating a preferred embodiment of the rare-earth sintered magnet in accordance with the present invention.

20 . . . first region; 22 . . . main phase; 24 . . . grain-boundary phase; 30 . . . stator; 32 . . . coil; 40 . . . second region; 42 . . . nitride; 50 . . . rotor; 52 . . . core; 54 . . . shaft; 100 . . . rare-earth sintered magnet; 200 . . . rotator

DESCRIPTION OF THE PREFERRED EMBODIMENTS

Mode for Carrying Out the Invention

In the following, preferred embodiments of the present invention will be explained with reference to the drawings as the case may be. In the drawings, the same or equivalent constituents will be referred to with the same sings, while omitting their overlapping descriptions.

FIG. 1 is a perspective view schematically illustrating the rare-earth sintered magnet in accordance with an embodiment.

This rare-earth sintered magnet 100 contains an R-T-B-based alloy as a main ingredient. Here, R, T, and B indicate a rare-earth element, at least one of iron (Fe) and cobalt (Co), and boron, respectively. The R-T-B-based alloy contains, as a rare-earth element, at least one element selected from the group consisting of scandium (Sc), yttrium (Y), and lanthanoids belonging to the group 3 of the long form of periodic table. Here, the lanthanoids include lanthanum (La), cerium (Ce), praseodymium (Pr), neodymium (Nd), samarium (Sm), europium (Eu), gadolinium (Gd), terbium (Tb), dysprosium (Dy), holmium (Ho), erbium (Er), thulium (Tm), ytterbium (Yb), and lutetium (Lu).

Preferably, the R-T-B-based alloy contains, as a rare-earth element, at least one element selected from the group consisting of Nd, Pr, Ho, and Tb or at least one element selected from the group consisting of La, Sm, Ce, Gd, Er, Eu, Tm, Yb, and Y. Preferably, the R-T-B-based alloy contains Fe as T. This can yield a rare-earth sintered magnet having an excellent magnetic characteristic at a relatively low cost.

A preferred example of the R-T-B-based alloy is an Nd—Fe—B-based alloy represented by $Nd_2Fe_{14}B$. The rare-earth sintered magnet 100 may contain a nonmagnetic Nd-rich or B-rich phase other than $Nd_2Fe_{14}B$ or a compound free of rare-earth elements or an alloy free of rare-earth elements. The Nd-rich phase is a phase in which Nd is the element having the highest content in elements constituting the phase, while the B-rich phase is a phase in which the B content is higher than in the $Nd_2Fe_{14}B$ phase.

The rare-earth content in the rare-earth sintered magnet 100 is preferably 8 to 40 mass %, more preferably 15 to 35 mass %. The rare-earth sintered magnet 100 having a high coercive force is harder to obtain when the rare-earth element content is less than 8 mass %. When the rare-earth element content exceeds 40 mass %, on the other hand, an R-rich nonmagnetic phase tends to increase, thereby lowering the residual magnetic flux density (Br) of the rare-earth sintered magnet 100. The R-rich phase is a phase in which R is the element having the highest content in elements constituting the phase.

The T content in the rare-earth sintered magnet 100 is preferably 42 to 90 mass %, more preferably 60 to 80 mass %. The residual magnetic flux density of the rare-earth sintered magnet 100 tends to decrease when the T content is less than 42 mass %, while the coercive force of the rare-earth sintered magnet 100 tends to decrease when the T content exceeds 90 mass %.

In the T contained in the rare-earth sintered magnet 100, the ratio of Fe is preferably at least 80 atom %, more preferably at least 90 atom %, further preferably 100 atom %. This can yield the rare-earth sintered magnet 100 having an excellent magnetic characteristic at a low manufacturing cost.

The B content in the rare-earth sintered magnet 100 is preferably 0.5 to 5 mass %. When the B content is less than 0.5 mass %, the coercive force of the rare-earth sintered magnet 100 tends to decrease. When the B content exceeds 5 mass %, the B-rich nonmagnetic phase tends to increase, thereby lowering the Br of the rare-earth sintered magnet 100. A part of B may be substituted by at least one element selected from the group consisting of carbon (C), phosphorus (P), sulfur (S), and copper (Cu). This can improve the productivity of the rare-earth sintered magnet 100, thereby cutting down its manufacturing cost.

From the viewpoint of improving the coercive force and productivity of the rare-earth sintered magnet 100 and cutting down its cost, the rare-earth sintered magnet 100 may contain at least one element selected from aluminum (Al), titanium (Ti), vanadium (V), chromium (Cr), manganese (Mn), bismuth (Bi), niobium (Nb), tantalum (Ta), molybdenum (Mo), tungsten (W), antimony (Sb), germanium (Ge), tin (Sn), zirconium (Zr), nickel (Ni), silicon (Si), gallium (Ga), copper (Cu), hafnium (Hf), and the like.

The rare-earth sintered magnet 100 may contain, as an inevitable impurity, at least one element selected from oxygen (O), nitrogen (N), carbon (C), calcium (Ca), and the like.

Figure 2:
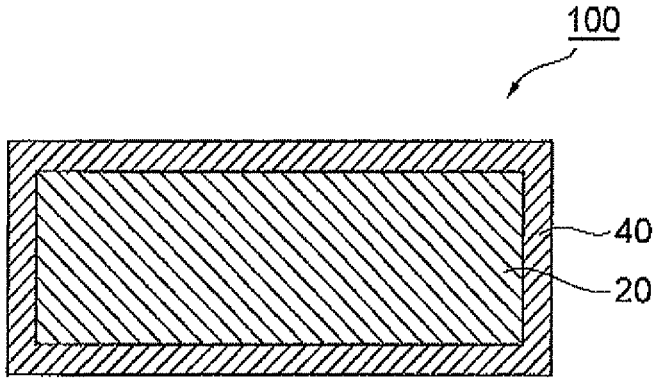
FIG. 2 is a sectional view taken along the line II-II of the rare-earth sintered magnet illustrated in FIG. 1.

FIG. 2 is a sectional view taken along the line II-II of the rare-earth sintered magnet 100 illustrated in FIG. 1. The rare-earth sintered magnet 100 has a first region 20 located within the rare-earth sintered magnet 100 and a second region 40 disposed so as to surround the first region 20.

Figure 3:
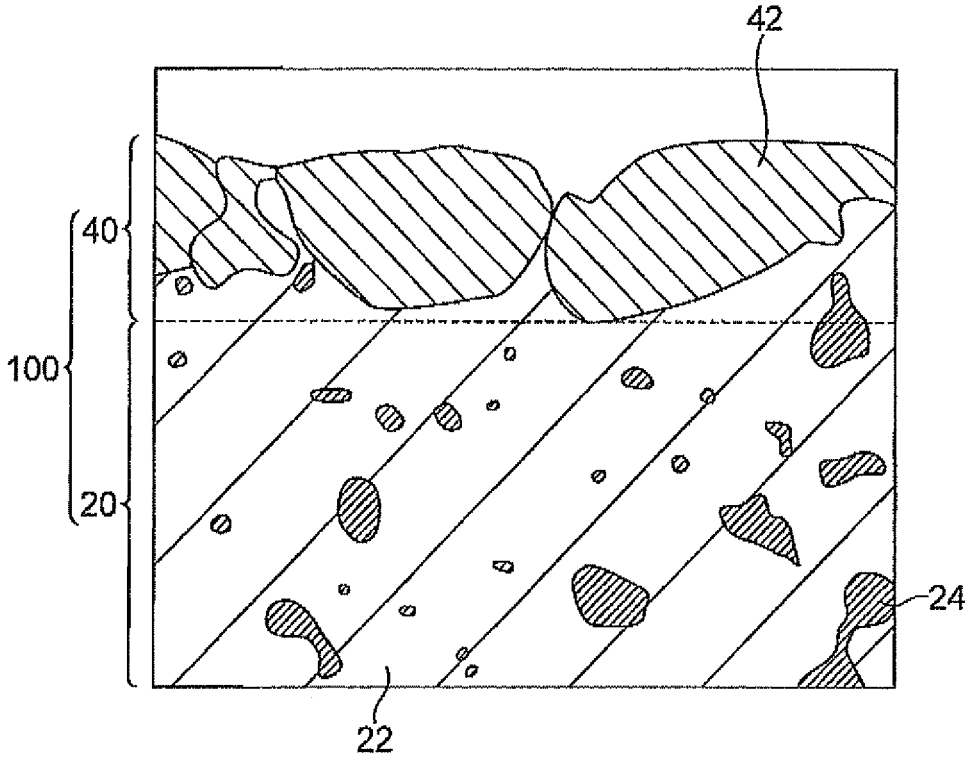
FIG. 3 is a schematic sectional view illustrating a cross-sectional structure of the rare-earth sintered magnet in accordance with the present invention under magnification.

FIG. 3 is an enlarged partial view schematically illustrating a microstructure of the rare-earth sintered magnet 100. The first region 20 is a region constituted by a part where the depth from the surface of the rare-earth sintered magnet 100 exceeds 20 μm, for example. The first region 20 has a main phase 22 made of magnetic particles of an R-T-B-based alloy and grain-boundary phases 24 constituted by a compound (alloy) having a composition different from that of the alloy contained in the main phase 22. The grain-boundary phases 24 may contain nonmagnetic R-rich and B-rich compounds, for example. However, it will be preferred if the first region 20 does not substantially contain nitrides of transition elements. This can inhibit nuclei for magnetization reversals from occurring in the first region 20 and increase the content of the R-T-B-based alloy having an excellent magnetic characteristic, thereby fully enhancing the magnetic characteristic of the rare-earth sintered magnet 100. The first region 20 containing substantially no transition element nitrides does not contain nitrides produced by nitriding which will be explained later, but may contain some nitrides as inevitable impurities derived from impurities in materials and the like, for example.

The second region 40 is a region containing a nitride 42 of a transition element and formed such as to cover the first region 20. The nitride 42 may be contained in a surface part of the rare-earth sintered magnet 100 while being dispersed as particles or forming a layer. The second region 40 may contain the main phase 22 made of magnetic particles of an R-T-B-based alloy and the grain-boundary phases 24 constituted by a compound having a composition different from that of the alloy contained in the main phase 22. That is, the second region 40 can be regarded as a region of a band containing the transition element nitride 42 which is disposed about the first region 20 to which the transition element nitride 42 is not distributed preferentially.

Letting the surface part (second region 40) be the part extending from the surface of the rare-earth sintered magnet 100 by a depth of 2 μm, the content of the transition element nitride 42 in the surface part (second region 40) in terms of nitrogen is preferably at least 1 mass %, more preferably at least 3 mass %, further preferably at least 5 mass % from the viewpoint of further improving the corrosion resistance. The upper limit for the content of the transition element nitride 42 in the surface part (second region 40) in terms of nitrogen is preferably 11 mass %, since its stoichiometric upper limit is about 11.1 mass %.

Letting the inner part (first region 20) be the part deeper than a depth of 2 μm from the surface of the rare-earth sintered magnet 100, the content of the transition element nitride 42 in the inner part (first region 20) in terms of nitrogen is preferably less than 0.1 mass %, more preferably less than 0.05 mass %, further preferably less than 0.03 mass % from the viewpoint of further improving the corrosion resistance. While there is no particular lower limit for the content of the transition element nitride 42 in the inner part (first region 20) of the rare-earth sintered magnet 100, about 0.01 mass % in terms of nitrogen may become a lower limit in a typical process because of impurities and the like.

In the specification, the transition element constituting the nitride 42 is an element selected from the first transition elements [scandium (Sc), titanium (Ti), vanadium (V), chromium (Cr), manganese (Mn), iron (Fe), cobalt (Co), nickel (Ni), and copper (Cu)] and second transition elements [yttrium (Y), zirconium (Zr), niobium (Nb), molybdenum (Mo), technetium (Tc), ruthenium (Ru), rhodium (Rh), palladium (Pd), and silver (Ag)] among those belonging to the groups 3 to 11 in the long form of periodic table. Preferably, from the viewpoint of chemical stability, the nitride 42 in this embodiment contains a nitride of the first transition element.

In the surface of the rare-earth sintered magnet 100, the areal ratio occupied by the nitride is preferably at least 50%, more preferably at least 70%, further preferably at least 90%. The areal ratio can be determined according to a calibration curve from a peak intensity detected by X-ray diffractometry on the surface of the rare-earth sintered magnet 100.

From the viewpoint of further improving the corrosion resistance, the nitride 42 preferably contains a nitride having T, which is a constituent element of the R-T-B alloy contained in the main phase 22, i.e., at least one element of Fe and Co, as a transition element, more preferably a nitride containing Fe. Specifically, it will be preferred if the nitride 42 contains a nitride represented by TxNy. Here, x and y are values each exceeding 0, while x/y=2 to 4. For example, x and y may be 2 to 4 and 1, respectively.

Examples of the nitride 42 represented by TxNy include iron nitrides such as $\alpha$-$Fe_{16}N_2$, $\gamma$-$Fe_4N$, and $\epsilon$-$Fe_{2-3}N$, cobalt nitrides such as $CO_3N$, and iron-cobalt nitrides such as $(Fe, Co)_{16}N_2$ having both Fe and Co as constituent elements. From the viewpoint of further improving the corrosion resistance, the nitride 42 preferably contains at least one of $\gamma$-$Fe_4N$ and $\epsilon$-$Fe_{2-3}N$, more preferably $\epsilon$-$Fe_{2-3}N$.

The content of the nitride 42 in the second region 40 is preferably at least 10 times, more preferably at least 20 times, than that in the first region 20. As the nitride 42 is thus distributed more preferentially to the vicinity of the surface of the rare-earth sintered magnet 100, both high magnetic characteristic and excellent resistance to corrosion can be satisfied at a higher level. The first region 20 may be totally free of the nitride 42.

The thickness of the second region 40 is preferably 1 to 20 μm, more preferably 1 to 10 μm, further preferably 2 to 8 μm. When the second region 40 is too thin, sufficiently high corrosion resistance tends to be lost. When the second region 40 is too thick, on the other hand, sufficiently high magnetic characteristic tends to be lost. When the nitride 42 is granular, the thickness of the second region 40 can be determined as the smallest thickness of a layer-like region (the distance from the surface of the rare-earth sintered magnet 100 to the dotted line in FIG. 3) including a major part of the nitride 42 (e.g., at least 95 mass % of the nitride 42 in total) distributed preferentially to the surface part of the rare-earth sintered magnet 100.

The fact that the nitride 42 is distributed preferentially to the surface part (second region 40) of the rare-earth sintered magnet 100 can be seen by X-ray diffractometry on the surface of the rare-earth sintered magnet 100 and glow discharge optical emission spectrometry adapted to carry out a composition analysis while shaving the rare-earth sintered magnet 100 in its thickness direction. That is, when (i) the fact that a transition element nitride is produced in the surface part can be seen by the X-ray diffractometry and (ii) the fact that the content of the nitride 42 is higher in the surface part (second region 40) than in the inner part (first region 20) can be seen by measuring the content of a constituent element along the depth direction of the rare-earth sintered magnet 100 by the glow discharge optical emission spectrometry, the nitride 42 can be said to be distributed preferentially to the surface part of the rare-earth sintered magnet 100.

An example of methods for manufacturing the rare-earth sintered magnet 100 in accordance with this embodiment will now be explained. The method for manufacturing rare-earth sintered magnet 100 explained here comprises a first step of manufacturing a magnet body, a second step of preprocessing the magnet body, a third step of surface-processing the magnet body so as to form a nitride in a surface part of the magnet body, and a fourth step of aging the rare-earth sintered magnet. The individual steps will now be explained in detail.

The first step manufactures the magnet body by a sintering method which will be explained in the following. First, a composition containing a rare-earth element, at least one of Fe and Co, and B at predetermined ratios is cast, so as to yield an ingot. Thus obtained ingot is roughly pulverized into a particle size on the order of 10 to 100 μm with a stamp mill or the like and then finely into a particle size on the order of 0.5 to 5 μm with a ball mill or the like, so as to produce a magnetic powder.

Next, thus obtained magnetic powder is molded, preferably in a magnetic field, so as to prepare a molded body. In this case, the applied magnetic field intensity is preferably at least 800 kA/m, while the molding pressure is preferably on the order of 100 to 500 MPa. Subsequently, thus prepared molded body is sintered at 1000 to 1200° C. for about 0.5 to 5 hr and then rapidly cooled. A sintered body (magnet body) can thus be obtained. Preferably, the sintering atmosphere is an inert gas atmosphere of an argon gas or the like.

When necessary, thus obtained sintered body may be processed into a predetermined form. Examples of the processing method include shaping such as cutting and shaving and chamfering such as barrel polishing. However, such processing is not always necessary.

The second step subjects a surface of the magnet body to the following preprocessing. Examples of the preprocessing include alkaline degreasing, acid washing, and ultrasonic cleaning. Such preprocessing can remove matters attached to the surface of the magnet body. This allows the third step, which will be explained later, to form the nitride more densely in the surface part of the magnet body. However, the second processing is not always necessary.

The third step forms the nitride in the surface part of the magnet body by nitriding. Examples of the nitriding method, which is not limited in particular, include i) heat treatment in a salt bath and ii) plasma nitriding. Simply heating in contact with a nitrogen gas, on the other hand, cannot form the nitride in the surface part of the magnet body.

The method of generating a nitride by salt-bath heat treatment is known as salt-bath nitriding or salt-bath soft nitriding in general. The method of generating a nitride by salt-bath heat treatment initially prepares a salt-bath heat treatment agent for forming the nitride. As the salt-bath heat treatment agent, one containing a known salt component can be used here.

Examples of the salt component in the salt-bath heat treatment agent (salt-bath processing salt) include cyan compounds, carbonates, and chlorides. Preferably used as a nitrogen source are salts having $CN^-$ or $CNO^-$ as an anion, such as sodium cyanide (NaCN), potassium cyanide (KCN), sodium cyanate (NaCNO), and potassium cyanate (KCNO).

The salt-bath heat treatment agent containing the above-mentioned salt component is heated to 500 to 600° C., so as to yield a molten salt, and the magnet body is immersed in the molten salt for 1 to 120 min. This forms the nitride in the surface part of the magnet body. Preferably, from the viewpoint of efficiently forming the nitride, the molten salt contains 10 to 50 mass % in total of cyan ($CN^-$) and cyanic acid ($CNO^-$) and 1 to 10 mass % of carbonic acid ($CO_3^{2-}$). It will also be preferred if the molten salt contains 35 to 60 mass % in total of sodium and potassium.

The amount of nitride produced in the surface part of the magnet body can be adjusted by changing the time for immersing the magnet body in the molten salt or the composition of the molten salt. The method of generating a nitride by salt-bath heat treatment is superior to the plasma nitriding, which will be explained later, in that the nitride can be formed densely in the surface part of the magnet body.

The method of generating a nitride by plasma nitriding nitrides the surface of the magnet body by using nitrogen in a plasma state with a commercially available plasma nitriding apparatus. This can produce the nitride in the surface part of the magnet body in a relatively short time. The amount of nitride produced in the surface part of the magnet body can be adjusted by changing the time for plasma processing or conditions for plasma processing. The method of generating a nitride by plasma nitriding is superior to the above-mentioned salt-bath heat treatment method in terms of safety.

When the magnet body contains $Nd_2Fe_{14}B$ as a main ingredient, for example, FezN (where z is a value ranging from 2 to 4) is produced as a nitride by nitriding. When the nitrogen content becomes 4 mass % or more by nitriding, a major part, e.g., 80 mass % or more, of $Nd_2Fe_{14}B$ in the surface part must have reacted. As a transition element nitride is generated, another reactant may be produced by a stoichiometric surplus of Nd or B, thereby changing the composition of a grain-boundary phase. In addition to the nitride generation, such a change in the grain-boundary phase may contribute to improving the corrosion resistance. The third step can yield the rare-earth sintered magnet 100. The subsequent fourth step may be carried out in order to improve the magnetic characteristic.

The fourth step ages the rare-earth sintered magnet having the nitride formed in the surface part. The aging is a process of heating for 1 to 5 hr at 400 to 900° C., preferably 450 to 700° C., preferably in an inert gas atmosphere. Such heat treatment (aging) can yield the rare-earth sintered magnet 100 having a higher magnetic characteristic.

The above-mentioned manufacturing method can produce the rare-earth sintered magnet 100 in which the transition element nitride is distributed preferentially to the surface part. Since the nitride is formed only in the surface part by nitriding, the rare-earth sintered magnet 100 can keep a magnetic characteristic substantially on a par with that of rare-earth sintered magnets having no nitrides. On the other hand, the rare-earth sintered magnet 100 is sufficiently superior to the rare-earth sintered magnets having no nitrides, since it has a structure in which the transition element nitride excellent in corrosion resistance is preferentially distributed to the surface part. Thus constructed rare-earth sintered magnet 100 can keep a sufficiently high magnetic characteristic over a long period. The rare-earth sintered magnet 100 having such a characteristic in accordance with this embodiment is favorably used as a permanent magnet for a rotator and a reciprocating motor, for example, in which excellent corrosion resistance is required.

Figure 4:
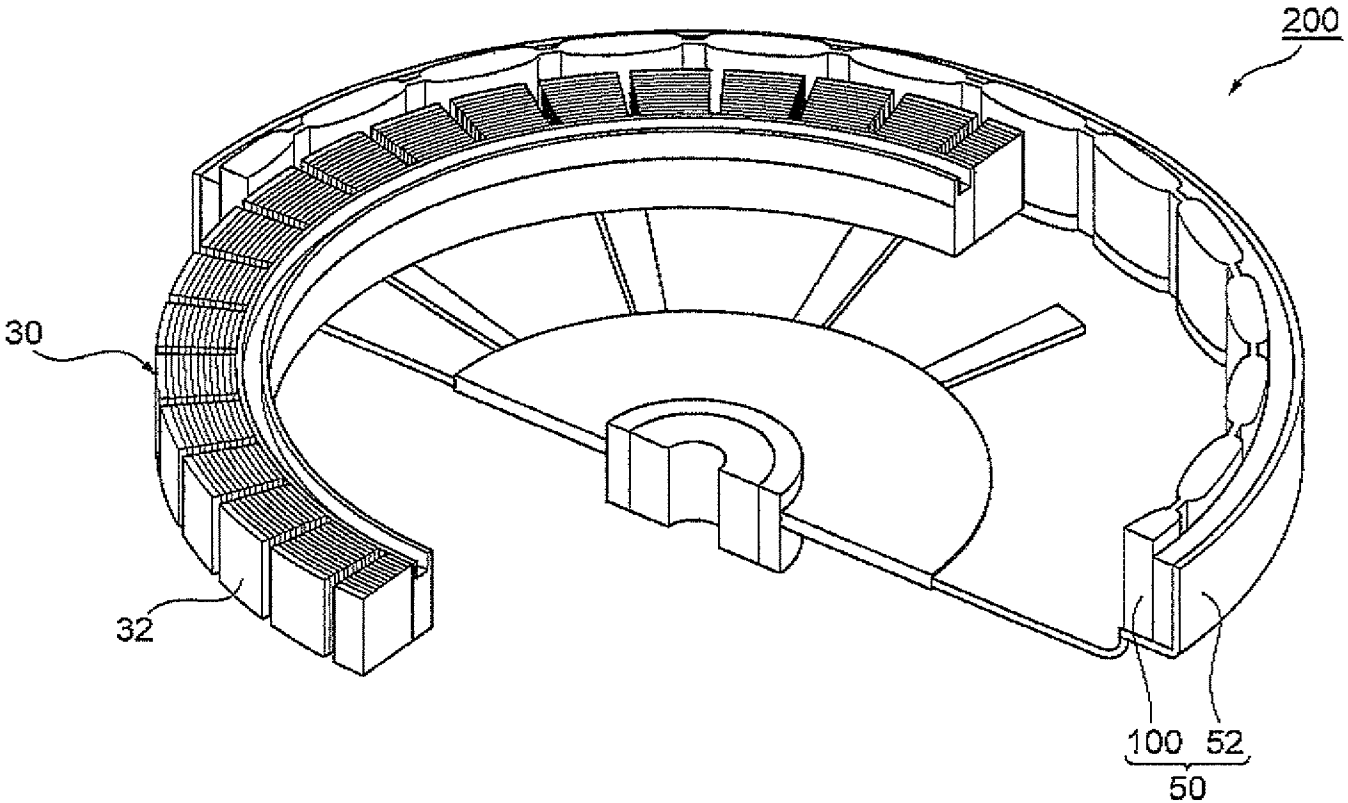
FIG. 4 is a perspective view schematically illustrating a preferred embodiment of the rotator in accordance with the present invention.

FIG. 4 is an explanatory view illustrating an inner structure of the rotator (permanent magnet rotator) in accordance with an embodiment. The rotator 200 in this embodiment is a synchronous permanent magnet rotator (SPM rotator) comprising a cylindrical rotor 50 and a stator 30 disposed on the inside of the rotor 50. The rotor 50 comprises a cylindrical core 52 and a plurality of rare-earth sintered magnets 100 disposed such that N and S poles alternate along the inner peripheral surface of the cylindrical core 52. The stator 30 has a plurality of coils 32 disposed along its inner peripheral surface. The series of coils 32 and the series of rare-earth sintered magnets 100 are arranged so as to oppose each other.

In the rotator 200, the rotor 50 is equipped with the rare-earth sintered magnets 100 in accordance with the above-mentioned embodiment. The rare-earth sintered magnets 100 are excellent in corrosion resistance and thus can fully inhibit the magnetic characteristic from decreasing with time. Therefore, the rotator 200 can keep excellent performances over a long time. The part other than the rare-earth sintered magnets 100 in the rotator 200 can be manufactured by a conventional method with typical rotator components.

The rotator 200 may be an electric motor (motor) which transforms electric energy to mechanical energy by an interaction between a field caused by an electromagnet generated upon energization of the coils 32 and a field formed by the permanent magnets 100. The rotator 200 may also be a power generator (generator) which transforms mechanical energy to electric energy by an electromagnetic inductive interaction between a field formed by the permanent magnets 100 and the coils 32.

Examples of the rotator 200 functioning as an electric motor (motor) include permanent magnet DC motors, linear synchronous motors, and synchronous permanent magnet motors (SPM and IPM motors). Examples of the rotator 200 functioning as an electric generator (generator) include synchronous permanent magnet generators, permanent magnet commutator generators, and permanent magnet AC generators.

Examples of the motor functioning as a reciprocating motor include voice coil motors and vibrating motors.

While preferred embodiments of the present invention have been explained in the foregoing, the present invention is not limited thereto. For example, while the rare-earth sintered magnet 100 in the above-mentioned embodiments has a structure in which the transition element nitride is distributed preferentially to the whole surface thereof, a portion of the surface part of the rare-earth sintered magnet in accordance with the present invention may be free of nitrides. That is, the transition element nitride may be distributed preferentially to only a portion of the surface part of the rare-earth sintered magnet. Thus providing the second region 40 in which the nitride is distributed preferentially to only a part requiring corrosion resistance can yield a rare-earth sintered magnet which can further enhance the magnetic characteristic and keep the high magnetic characteristic over a long period.

EXAMPLES

The present invention will now be explained more specifically with reference to examples and comparative examples but will not be restricted to the following examples.

Making of Rare-Earth Sintered Magnet and Composition Analysis

Example 1

Making of a Magnet Body

An ingot made of an Nd—Dy—Fe—B-based alloy was obtained by a powder-metallurgical method. This ingot had a composition comprising 27.4 mass % of Nd, 3 mass % of Dy, 68.6 mass % of Fe, and 1 mass % of B. The ingot was pulverized by a stamp mill and a ball mill, so as to yield a fine alloy powder having the above-mentioned composition.

Thus obtained fine alloy powder was press-molded in a magnetic field, so as to prepare a molded body. The molded body was sintered while being held at a temperature of 1100° C. for 1 hr, so as to yield a sintered body. Thereafter, an argon gas at normal temperature was introduced, so as to cool the sintered body rapidly to normal temperature. After the cooling, the sintered body was processed into a rectangular parallelepiped form having a size of 20×20×12 (mm), whereby a magnet body was obtained.

Preprocessing

The magnet body was subjected to preprocessing which sequentially carries out alkaline degreasing, water washing, acid washing with a nitric acid solution, water washing, smut removal by ultrasonic cleaning, water washing, and drying.

Salt-Bath Reprocessing

A salt-bath heat treatment agent (salt-bath processing salt) having the following composition was prepared.

Sodium cyanide (NaCN): 60 mass %

Sodium chloride (NaCl): 35 mass %

Sodium carbonate ($Na_2CO_3$): 5 mass %

The magnet body produced as mentioned above was immersed in a molten salt (at a temperature of 570° C.) having the above-mentioned composition for 30 min, so as to perform nitriding, whereby a rare-earth sintered magnet was obtained. Thereafter, the rare-earth sintered magnet was taken out from the molten salt and cooled in the air to normal temperature. Then, the rare-earth sintered magnet was immersed in an aqueous solution containing 1 mass % of sodium tetraborate decahydrate ($Na_2B_4O_7.10H_2O$), so as to remove salt components attached to the surface. Thereafter, the rare-earth sintered magnet was washed with water and dried.

Aging

The rare-earth sintered magnet was held at 600° C. for 1 hr in an argon gas atmosphere, so as to age the magnet body. The foregoing process produced the rare-earth sintered magnet of Example 1.

Composition Analysis

X-ray diffractometry was carried out on the surface of thus obtained rare-earth sintered magnet. The chart A in FIG. 5(*a*) is an X-ray diffraction chart (CuKα) of the rare-earth sintered magnet in Example 1. As a result of the X-ray diffractometry, the surface part of the rare-earth sintered magnet was mainly composed of a nitride of iron ($\epsilon$-$Fe_{2-3}N$).

The composition analysis was carried out in the surface part and inner part of the rare-earth sintered magnet by glow discharge optical emission spectrometry (with an apparatus named GD-Profiler 2 manufactured by Jobin Yvon S. A. S.). As a result, the nitrogen content was 5 mass % or more in the region extending by a depth of 5 μm from the surface of the rare-earth sintered magnet. When the depth from the surface exceeded 5 μm, on the other hand, the nitrogen content decreased greatly as the depth increased. In the region where the depth from the surface exceeded 5 μm, the nitrogen content was 0.05 mass % or less, and no nitrides generated by nitriding were included therein.

Example 2

A rare-earth sintered magnet was produced as in Example 1 except that a salt-bath heat treatment agent having the following composition was used for salt-bath processing and that the temperature of the molten salt was 580° C. The rare-earth sintered magnet of Example 2 was thus obtained.

Sodium cyanide (NaCN): 35 mass %

Potassium cyanate (KCNO): 55 mass %

Potassium carbonate ($K_2CO_3$): 10 mass %

Thus obtained rare-earth sintered magnet was analyzed as in Example 1. As a result of the X-ray diffractometry, the surface part of the rare-earth sintered magnet was mainly composed of nitrides of iron ($\epsilon$-$Fe_{2-3}N$ and $\gamma$-$Fe_4N$). As a result of the glow discharge optical emission spectrometry, the nitrogen content was 3 mass % or more in the region extending by a depth of 3 μm from the surface of the rare-earth sintered magnet. When the depth from the surface exceeded 3 μm, on the other hand, the nitrogen content decreased greatly as the depth increased. In the region where the depth from the surface exceeded 3 μm, the nitrogen content was 0.05 mass % or less, and no nitrides generated by nitriding were included therein.

Example 3

An ingot made of an Nd—Dy—Fe—Co—B-based alloy was obtained by a powder-metallurgical method. This ingot had a composition comprising 27.4 mass % of Nd, 3 mass % of Dy, 61.4 mass % of Fe, 7.2 mass % of Co, and 1 mass % of B. The ingot was pulverized by a stamp mill and a ball mill, so as to yield a fine alloy powder having the above-mentioned composition. A rare-earth sintered magnet was produced as in Example 1 except that the above-mentioned fine alloy powder was used in place of the fine alloy powder of Example 1. The rare-earth sintered magnet of Example 3 was thus obtained.

Thus obtained rare-earth sintered magnet was analyzed as in Example 1. As a result of the X-ray diffractometry, the surface part of the rare-earth sintered magnet was mainly composed of a nitride of iron ($\epsilon$-$Fe_{2-3}N$) and a nitride of cobalt ($CO_3N$). As a result of the glow discharge optical emission spectrometry, the nitrogen content was 5 mass % or more in the region extending by a depth of 5 μm from the surface of the rare-earth sintered magnet. When the depth from the surface exceeded 5 μm, on the other hand, the nitrogen content decreased greatly as the depth increased. In the region where the depth from the surface exceeded 5 μm, the nitrogen content was 0.05 mass % or less, and no nitrides generated by nitriding were included therein.

Example 4

A magnet body was produced and preprocessed as in Example 1. The preprocessed magnet body was placed in a vacuum film-forming chamber, which was then evacuated to a pressure of $1\times10^{-3}$ Pa or lower. Subsequently, the magnet body was subjected to plasma nitriding under the following condition, so as to yield a rare-earth sintered magnet.

Introduced gas: nitrogen

Gas flow rate: 600 ml/min (the flow rate of the introduced gas being a value obtained by converting the temperature and pressure to 25° C. and 1 atm, respectively)

Pressure within the chamber: 800 Pa

Surface temperature of the magnet body: 550° C.

High-frequency power: 300 W

Processing time: 3 hr

After the above-mentioned plasma nitriding, the rare-earth sintered magnet was held at 600° C. for 1 hr in an argon gas atmosphere, so as to be aged. The foregoing process yielded the rare-earth sintered magnet of Example 4.

Thus obtained rare-earth sintered magnet was analyzed as in Example 1. As a result of the X-ray diffractometry, the surface part of the rare-earth sintered magnet was mainly composed of a nitride of iron ($\gamma$-$Fe_4N$). As a result of the glow discharge optical emission spectrometry, the nitrogen content was 1 mass % or more in the region extending by a depth of 2 μm from the surface of the rare-earth sintered magnet. When the depth from the surface exceeded 2 μm, on the other hand, the nitrogen content decreased greatly as the depth increased. In the region where the depth from the surface exceeded 2 μm, the nitrogen content was 0.05 mass % or less, and no nitrides generated by nitriding were included therein.

Comparative Example 1

A magnet body was made as in Example 1. Thereafter, without the preprocessing and salt-bath processing, aging was carried out as in Example 1, so as to produce a rare-earth sintered magnet as in Example 1. The rare-earth sintered magnet of Comparative Example 1 was thus obtained. The rare-earth sintered magnet was analyzed as in Example 1.

Figure 5:
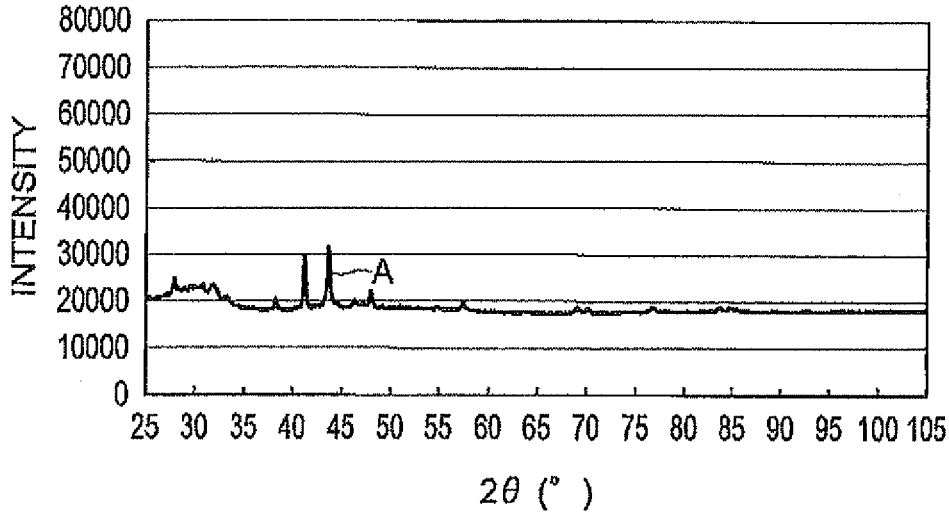
FIG. 5 is a graph illustrating X-ray diffraction charts of the rare-earth sintered magnets of Example 1 and Comparative Example 1.
Figure 5:
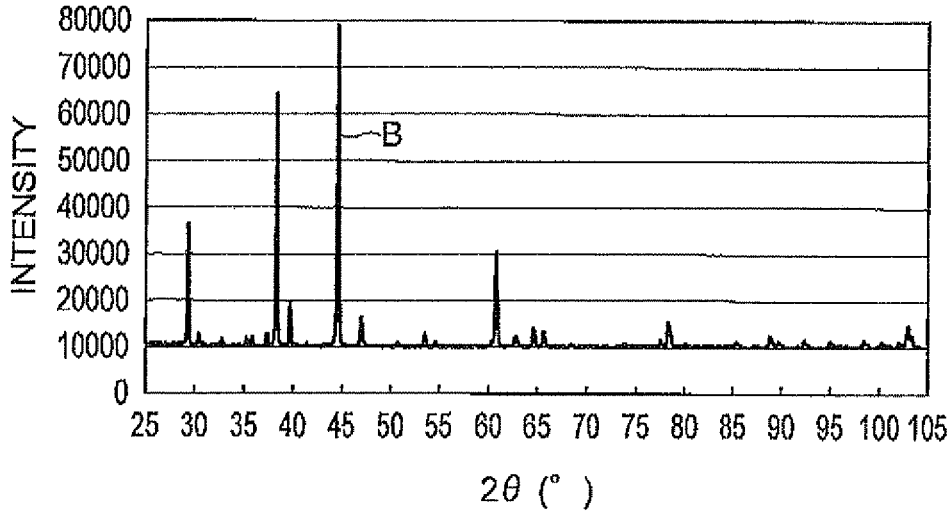

The chart B in FIG. 5(*b*) is an X-ray diffraction chart (CuK$\alpha$) of the rare-earth sintered magnet in Comparative Example 1. As a result of the X-ray diffractometry, the surface part of the rare-earth sintered magnet was mainly composed of $Nd_2Fe_{14}B$, while no nitrides of iron were detected. As a result of the glow discharge optical emission spectrometry, the nitrogen content did not vary at all along the depth direction from the surface of the rare-earth sintered magnet, whereby there was no difference in nitrogen content between the surface part and inner part of the rare-earth sintered magnet. The nitrogen content was 0.05 mass % or less in each of the surface part and inner part of the rare-earth sintered magnet.

Comparative Example 2

A fine alloy powder was prepared as in Example 1. This fine alloy powder was held at 400° C. for 10 min in an ammonia gas atmosphere, so that nitrogen was diffused. A rare-earth sintered magnet was made as in Comparative Example 1 except that the nitrogen-diffused fine alloy powder was used. The rare-earth sintered magnet of Comparative Example 2 was thus obtained. The rare-earth sintered magnet was analyzed as in Example 1.

As a result of the X-ray diffractometry, the surface part of the rare-earth sintered magnet was mainly composed of $Nd_2Fe_{14}B$, while no nitrides of iron were detected. As a result of the glow discharge optical emission spectrometry, the nitrogen content did not vary at all along the depth direction from the surface of the rare-earth sintered magnet, whereby there was no difference in nitrogen content between the surface part and inner part of the rare-earth sintered magnet. The nitrogen content was 0.05 mass % or less in each of the surface part and inner part of the rare-earth sintered magnet.

Notwithstanding the nitrogen diffusion in the fine alloy powder, the nitrogen content in the surface part and inner part of the rare-earth sintered magnet was on a par with that in Comparative Example 1. This seems to be because of the fact that nitrogen atoms dropped out of alloy particles at the time of sintering the molded body.

Comparative Example 3

A rare-earth sintered magnet was made as in Comparative Example 1 except that, after being produced, the sintered body was cooled by introducing a nitrogen gas instead of the argon gas. The rare-earth sintered magnet of Comparative Example 3 was thus obtained.

The rare-earth sintered magnet was analyzed as in Example 1. As a result of the X-ray diffractometry, the surface part of the rare-earth sintered magnet was mainly composed of $Nd_2Fe_{14}B$, while no nitrides of iron were detected. As a result of the glow discharge optical emission spectrometry, the nitrogen content did not vary at all along the depth direction from the surface of the rare-earth sintered magnet, whereby there was no difference in nitrogen content between the surface part and inner part of the rare-earth sintered magnet. The nitrogen content was 0.08 mass % or less in each of the surface part and inner part of the rare-earth sintered magnet.

Comparative Example 4

A magnet body was made and preprocessed as in Example 1. The preprocessed magnet body was held at a temperature of 400° C. for 10 min in the air, so as to be oxidized, whereby a rare-earth sintered magnet was obtained. Thereafter, the rare-earth sintered magnet was left in the air at normal temperature, so as to be cooled. The rare-earth sintered magnet was then aged as in Example 1. The rare-earth sintered magnet of Comparative Example 4 was thus obtained. This rare-earth sintered magnet was analyzed as in Example 1.

As a result of the X-ray diffractometry, the surface part of the rare-earth sintered magnet was mainly composed of $Nd_2Fe_{14}B$ and $Fe_2O_3$, while no nitrides of iron were detected. As a result of the glow discharge optical emission spectrometry, the nitrogen content did not vary at all along the depth direction from the surface of the rare-earth sintered magnet, whereby there was no difference in nitrogen content between the surface part and inner part of the rare-earth sintered magnet. The nitrogen content was 0.05 mass % or less in each of the surface part and inner part of the rare-earth sintered magnet.

Evaluation of Rare-Earth Sintered Magnet Characteristics

The corrosion resistance and magnetic characteristic of each of the rare-earth sintered magnets obtained in the examples and comparative examples as a sample were evaluated according to the following procedure.

Corrosion Resistance Evaluation

A pressure cooker test (PCT) was carried out in an atmosphere where saturated water vapor existed at a sample temperature of 121° C. The sample was held for 100 hr under this condition, and thereafter its surface state was visually observed. This visual test was evaluated by the following criteria. Table 1 lists the results of evaluation.

A: There was no change in the exterior of the sample between before and after the PCT.

B: The surface of the sample changed to black with powder dropping out after the PCT.

Also, the mass decrease caused by the PCT was calculated. Specifically, the mass of the sample was measured before and after the PCT, and the difference in mass was divided by the surface area of the sample, so as to calculate the decrease in mass per unit area. Table 1 lists the results of evaluation.

Magnetic Characteristic Evaluation

Using a BH tracer, the maximum BH product was measured by the following procedure. Using a model TRF-5BH (product name) manufactured by Toei Industry Co., Ltd., the magnetic field density [$kg/s^2 \cdot A$] was measured when a magnetic field was applied at 0 [kA/m], 2000 [kA/m], 0 [kA/m], and −2000 [kA/m] in this order while being swept at a sweep rate of 80 [kA/m·s]. After a demagnetization curve was thus obtained, the maximum BH product was determined. Table 1 lists the results of evaluation.

TABLE 1

| | Corrosion resistance | | Magnetic characteristic |
|---|---|---|---|
| | Visual test | Mass decrease [$mg/cm^2$] | Max BH product [$kJ/m^3$] |
| Example 1 | A | <0.1 | 355.7 |
| Example 2 | A | <0.1 | 350.1 |
| Example 3 | A | <0.1 | 343.8 |
| Example 4 | A | 0.1 | 352.5 |
| Comparative Example 1 | B | 3.8 | 354.1 |
| Comparative Example 2 | B | 3.6 | 348.5 |
| Comparative Example 3 | B | 0.8 | 324.7 |
| Comparative Example 4 | B | 1.9 | 351.7 |

The rare-earth sintered magnets of Examples 1 to 4 were excellent in corrosion resistance and had magnetic characteristics on a par with those of the rare-earth sintered magnet of Comparative Example 1 having no nitrides on its surface. On the other hand, the rare-earth sintered magnets of Comparative Examples 1 to 4 were insufficient in terms of corrosion resistance. Comparative Example 3 exhibited a small decrease in mass but had a low magnetic characteristic. The high nitrogen content is deemed to have worsened the magnetic characteristic. Though an oxide seems to have occurred in the surface part of the rare-earth sintered magnet in Comparative Example 4, its corrosion resistance was not sufficient.

Validation of Aging Condition

For optimizing the aging condition, an optimal aging temperature was investigated while changing the holding temperature at the time of aging the rare-earth sintered magnets of the examples and comparative examples. Aging was carried out at each of the holding temperatures of 480° C., 520° C., 560° C., 600° C., 640° C., and 680° C., and the corrosion resistance and magnetic characteristic were evaluated as mentioned above. As a result, a rare-earth sintered magnet having the best corrosion resistance and magnetic characteristic was obtained in each of the examples and comparative examples when the holding temperature was 600° C.

INDUSTRIAL APPLICABILITY

The present invention can provide a rare-earth sintered magnet having an excellent magnetic characteristic while being highly resistant to corrosion. It can also provide a rotator and a reciprocating motor which can keep excellent performances over a long period.

What is claimed is:

1. A rare-earth sintered magnet containing an R-T-B-based alloy and a nitride of at least one element selected from the group consisting of iron and cobalt, wherein:

R, T, and B indicate a rare-earth element, at least one transition element selected from the group consisting of iron and cobalt, and boron, respectively;

the nitride is distributed preferentially to a surface part of the rare-earth sintered magnet; and the element contained in the nitride is the same as the transition element T.

2. The rare-earth sintered magnet according to claim 1, wherein the nitride contains TxNy, where N indicates nitrogen, and x and y indicate values each exceeding 0, while x/y=2 to 4.

3. The rare-earth sintered magnet according to claim 1, wherein the rare-earth sintered magnet has first and second regions, the first region being substantially free of the nitride, the second region containing the nitride and covering the first region.

4. The rare-earth sintered magnet according to claim 1, wherein:

the surface part is part extending by a depth of 2 μm from a surface; and the surface part has a nitride content of 1 to 11 mass % in terms of nitrogen.

5. A rotator comprising the rare-earth sintered magnet according to claim 1.

6. A reciprocating motor comprising the rare-earth sintered magnet according to claim 1.

7. The rare-earth sintered magnet of claim 1, wherein the nitride is at least one nitride selected from the group consisting of $\alpha$-$Fe_{16}N_2$, $\gamma$-$Fe_4N$, $\epsilon$-$Fe_{2-3}N$, $Co_3N$, and $(Fe, Co)_{16}N_2$.

8. The rare-earth sintered magnet of claim 1, wherein the nitride is at least one nitride selected from the group consisting of $\gamma$-$Fe_4N$, $\epsilon$-$Fe_{2-3}N$, and $Co_3N$.

* * * * *